US005771016A

United States Patent [19]

Mullins et al.

[11] Patent Number: 5,771,016

[45] Date of Patent: Jun. 23, 1998

[54] PHASED ARRAY RADAR WITH SIMULTANEOUS BEAM-STEERING AND SINGLE-SIDEBAND MODULATION

[75] Inventors: James H. Mullins; Ralph H. Halladay, both of Huntsville; Michael R. Christian, Owens Cross Rd., all of Ala.

[73] Assignee: The United States of America as represented by the Secretary of the Army, Washington, D.C.

[21] Appl. No.: 986,202

[22] Filed: Dec. 5, 1997

[51] Int. Cl.[6] ..... H01Q 3/22; H01Q 3/24; H01Q 3/26

[52] U.S. Cl. ..... 342/372; 342/154; 342/157

[58] Field of Search ..... 342/372, 81, 154, 342/157, 158

[56] References Cited

U.S. PATENT DOCUMENTS 5,592,178 1/1997 Chang et al. ..... 342/372

5,623,270 4/1997 Kempkes et al. ..... 342/372

*Primary Examiner*—Theodore M. Blum

*Attorney, Agent, or Firm*—Arthur H. Tischer; Hay Kyung Chang

[57] ABSTRACT

In a phased array radar, simultaneous beam steering and single-sideband modulation is accomplished in the phase shifters in response to phase control signals produced by the beam steering controller and input to the phase shifters. The beam steering controller produces the phase control signals from a pre-selected beam steering angle, a pre-selected radar intermediate frequency and a voltage representing the frequency error from incomplete compensation of the target motion (doppler) of the previous cycle of the radar. Using the phase shifters thusly eliminates the need for an expensive separate component, the single sideband modulator.

2 Claims, 4 Drawing Sheets

PHASED ARRAY RADAR WITH SIMULTANEOUS BEAM-STEERING AND SINGLE-SIDEBAND MODULATION

DEDICATORY CLAUSE

The invention described herein may be manufactured, used and licensed by or for the Government for governmental purposes without the payment to us of any royalties thereon.

BACKGROUND OF THE INVENTION

PART I

In a conventional phased array radar configuration, the radar antenna is composed of individual radiating elements 119, 121, 123 and the radar beam is steered by generating a phase gradient across the antenna. This phase gradient is generated by incrementing equally between radiating elements the phase of the transmitted signal. Thus, the radiated beam steering direction and angle is determined by the relative phase relationship between adjacent radiating elements. The mathematical relationship between the relative phase difference between two adjacent radiating elements, such as 119 and 121, and the radar beam steering angle, θ, is $$\phi = \frac{2\pi d}{\lambda} \operatorname{Sin}(\theta) \tag{1}$$

where λ(the radar wavelength)=c/f, c(the speed of light)= $3\times10^8$ meters/second, f is the radar RF frequency and d is the spacing between adjacent radiating elements. As shown in FIGS. 1 and 3, phase shifters, 113, 115, 117 that precede the radiating elements are used to adjust the phase of the signal applied to each radiating element and thus to direct the transmitted beam. Phase shifters, 113, 115 117 may be analog with a continuously variable phase from 0 to 360 degrees or digital with discrete phase steps from 0 to 360 degrees. Digital phase shifters are characterized by their number of bits where, for example, a 5-bit digital phase shifter will have $2^5$=32 levels of adjustment or an adjustment resolution of 11.25 degrees. Equation (1) can be used to calculate that a 5-bit phase shifter will be capable of adjusting the relative phase between adjacent radiating elements and thus providing angular steering to the radiating signal as shown below:

| | | | | | | | | |
|---|---|---|---|---|---|---|---|---|
| PHASE SHIFTER LEVEL | 1 | 2 | 3 | 4 | ---- | 16 | ---- | 32 |
| PHASE SHIFTER (degrees) | 11.25 | 22.5 | 33.75 | 45 | ---- | 180 | --- | 360 |
| BEAM STEERING ANGLE (deg) | 3.58 | 7.18 | 10.8 | 14.48 | -- | 90 | | |

However, if a 10-degree beam steering angle is desired, the required phase difference between radiating elements can be calculated from Equation (1) as $$\phi=\pi\operatorname{Sin}(10)=0.545 \text{ rad}=31.25 \text{ deg.} \tag{2}$$

So, the phase shifters would be set to provide a 33.75 degree phase difference (the closest available with the 5-bit digital phase shifter) between adjacent radiating elements and would provide a beam steering angle near 10 degrees (actually 10.8 degrees). Thus the digital phase shifters steer the antenna beam to discrete angular location which are, in general, near but not exactly the desired angle. This can be improved by increasing the number of bits in the phase shifters or by the use of an analog (continuously adjustable phase shifter). Analog phase shifters, however, pose problems in maintaining the same phase difference between adjacent elements and for this reason digital shifters are usually preferred.

As depicted in FIG. 1, passive phased arrays use phase shifters only. But transmit power amplifiers 131, 133 and low noise receive amplifiers 135, 137 can be incorporated into the array structure, as shown in FIG. 2, to form an active phased array. In either case, the power from each radiating element combines in space or, because of reciprocity, it is in-phase combined on receive.

Modern radars which use superheterodyne front-ends must frequency-translate transmitted signals relative to the receiver's local oscillator frequency to achieve the desired intermediate frequency. This is typically accomplished by single sideband modulator (SSB MOD) 103 whose function precedes that of the transmitting means of radar 100. The single sideband modulator is a basic frequency conversion component that accepts as inputs signals at two different frequencies and provides as an output a signal with a frequency that is the sum (or the difference) of the two signals but not both. Thus, if the inputs are two signals, one at a frequency of fi and the other at a frequency fif, the single sideband modulator will provide as an output a signal at a frequency fi+fif or at a frequency fi−fif, but not both. The single sideband modulator is useful in a radar system to provide a transmit signal that is different in frequency (ex. fi+fif) from an on-board reference signal (ex. fi). In the receive process, the two signals (the signals at fi and fi+fif) can be mixed together to create an intermediate frequency signal which is at a lower frequency, fif, and is thus easier to process.

Further, a frequency offset between the transmitted signal and the on-board reference frequency is used for motion compensation (i.e. to remove the effects of target motion called target doppler) so that the intermediate frequency remains constant. As the target motion is, in general, not constant, the frequency offset used for the motion compensation must be adjustable over the range of target motion velocity that is to be processed by radar 100. As an example, consider a radar operating at 10 gigahertz and having an intermediate frequency of 1 megahertz and capable of processing target motion (radial velocity with respect to the radar) of 150 meters per second. The frequency offset is 1 megahertz plus the frequency shift caused by the target motion. The maximum target radial velocity results in a doppler frequency shift of $$fd = \frac{2v}{\lambda} = \frac{2(150)}{0.03} = 10{,}000 = 10 \text{ kHz} \tag{3}$$

where the sign of the doppler frequency is positive for an approaching target and negative for a receding target. The single sideband modulator is set to provide both the frequency offset required to produce the intermediate frequency of 1 megahertz and to compensate for the target doppler. Thus, for this particular example, the on-board reference signal frequency is set to 10 gigahertz and when the target radial velocity is at its maximum positive value of 150 meters per second, the single sideband modulator is set to provide a signal which is different in frequency by 1.0–0.01 megahertz. This signal is transmitted and reflected from the target where a plus 0.01 megahertz frequency shift (doppler) is added by the target motion. The signal returned from the target is now shifted by 1 megahertz from the on-board reference frequency and, in the down conversion process in receiver 107, results in a 1 megahertz signal which is compatible with the radar intermediate frequency processing circuits.

PART II

Referring now to the drawing wherein like numbers represent like parts in each of the several figures and arrows indicate the direction of signal travel, a description of the prior art as depicted first in FIG. 1, then in FIG. 2, is given.

FIG. 1 is a diagram of a typical passive phased array. Frequency generator (FREQ GEN) 101 generates a signal at the radar reference frequency (fi) and another signal at the radar intermediate frequency (fif) which is used to demodulate the signal received from the target. Signals fi and fif are pre-selected during the design process of radar 100 and are programmed into single sideband modulator 103. Then for the operation of the radar, the reference signal at frequency fi is input to receiver (RECV) 107. The frequency generator also generates an updated doppler compensation signal, fd, in response to the input voltage which is a function of the doppler compensation frequency from the previous cycle and the compensation frequency error (fde). The updated doppler compensation signal is input to both single sideband modulator 103 and frequency discriminator (FREQ DISC) 127. The single sideband modulator accepts the input signals fi, fif and fd and translates them to a transmit signal, fi+fif−fd, which is applied to transmit amplifier (XMIT AMP) 105 where the power of the transmit signal is increased prior to the signal being input to duplexer 109. The duplexer routes the transmit signal to waveguide manifold 111 which, in turn, distributes the signal to phase shifters 113, 115, 117. The phase shifters receive the transmit signal and adjust the phase thereof in response to phase control signals (consonant with a beam-steering angle, θ, pre-selected by the operator of the radar) received from beam steering controller 129. The phase-adjusted transmit signal is then input from the phase shifters to radiating elements 119, 121, 123 to be transmitted outwardly in a desired angle (steered) toward the target (not shown). When the target reflects the transmitted signal and returns the signal to radar 100, the target adds a doppler frequency, fd+fde, to the return signal where fde represents the difference between the compensated doppler and the actual target doppler. The return signal is received by the radiating elements, is phase-adjusted in the phase shifters and combined in waveguide manifold 111 prior to being routed to duplexer 109 whence it proceeds to receiver 107. The receiver accepts the pre-selected reference frequency signal, fi from frequency generator 101, and the return signal, fi+fif+fde, and translates the latter signal to the difference (intermediate) frequency, fif+fde, and amplifies and translates it to baseband frequency that is indicative of the baseband data of the target such as the range, magnitude and velocity of the target as well as producing the frequency error, fde, representing the incomplete compensation of the target motion (doppler). The baseband data is input to signal processor (SIG PROC) 125 which processes the data and displays it for operator observation. The frequency error, fde, is input to frequency discriminator 127 which converts it and fd, originally input from frequency generator 101, to voltage, V, representative of the current doppler compensation and associated error. Voltage, V, is applied to frequency generator which updates the doppler compensation signal to a new, updated doppler compensation frequency.

A typical active phased array is illustrated in FIG. 2. The active phased array radar shares with the passive phased array radar many common components whose functions are as described above. In addition, the active array radar has multiple transmit/receive switches, 143, 145, one switch coupled to one phase shifter, a power amplifier and a low noise amplifier. The switches receive phase-adjusted transmit signals from phase shifters and route the signals to power amplifiers 131, 133. The power amplifiers duly amplify the signals which are, then, input to radiating elements 119, 121 via transmit/receive circulators, 239, 241 to be transmitted outwardly toward the target (not shown). The transmitted signals reflect from the target and are received by the radiating elements 119, 121, routed by the transmit/receive circulators to low noise amplifiers 135, 137 which appropriately amplify the return signals. The amplified return signals are further routed by the transmit/receive switches to the phase shifters.

SUMMARY OF THE INVENTION

A phased array radar with simultaneous beam steering and single-sideband modulation simultaneously performs both beam steering and single sideband modulation of the radar signal in phase shifters 113, 115, 117 rather than have a separate component (single sideband modulator) for the modulation. This reduces the number of expensive millimeter wave components in missile seekers and ground based radars.

DESCRIPTION OF THE PREFERRED EMBODIMENT

The simultaneous performance of beam steering and single-sideband modulation is achieved by providing the desired relative phase shift between adjacent radiating elements 119, 121, 123 (via their associated phase shifters) to position the transmit beam correctly, while serrodyne-modulating with the phase shifters by continuously ramping the phase of each phase shifter through 360 degree phase states. Serrodyne modulation is the translation of an input signal, either upward or downward, but not both, in frequency by the addition of a controlled phase shift. Thus at any instant in time, the correct beam steering relative phase from one radiating element to the next radiating element is maintained, yet the frequency of the carrier is shifted because the absolute phase for each radiating element is being changed as a function of time. This frequency shift is equal to:

$$\Delta f = \frac{1}{2\pi} \frac{d\phi}{dt} \tag{4}$$

where $d\phi/dt$ is the change of phase with respect to time. Since the phase change with respect to time is easily varied, this provides controllable offset frequencies.

Figure 1:
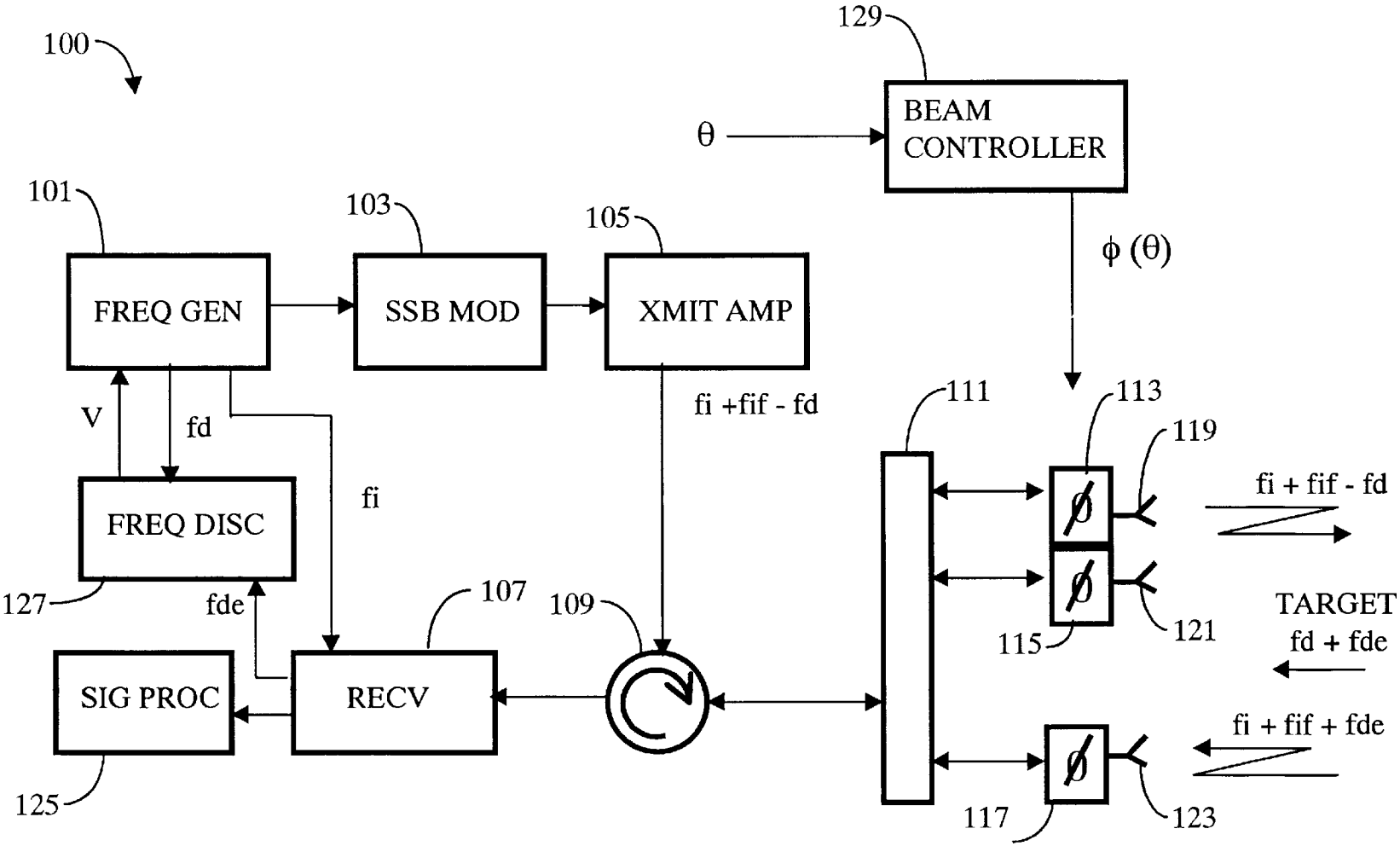
FIG 1. PRIOR ART
FIG. 1 is a diagram of a typical passive phased array radar.
Figure 2:
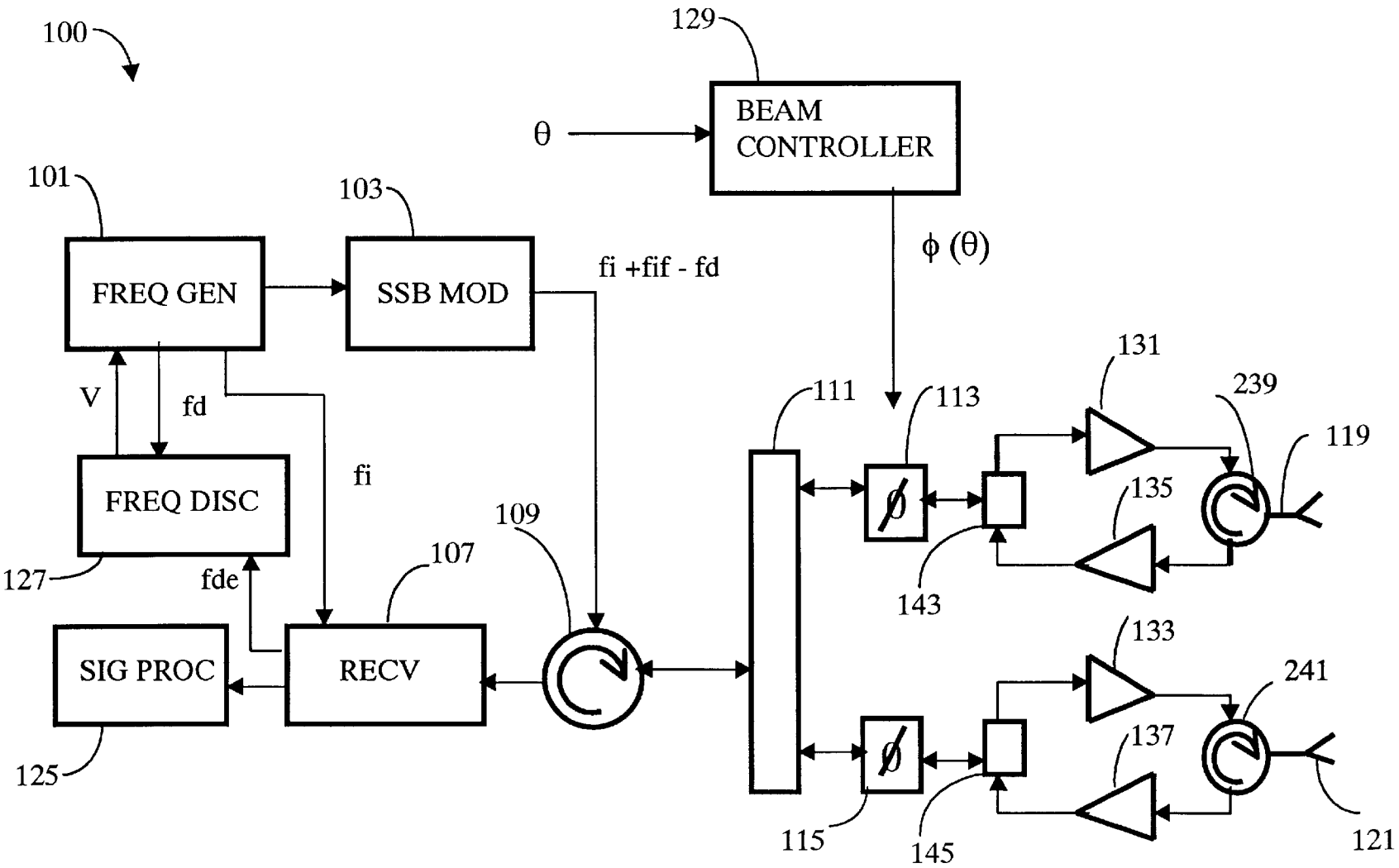
FIG 2. PRIOR ART
FIG. 2 is a diagram of a typical active phased array radar.
Figure 3:
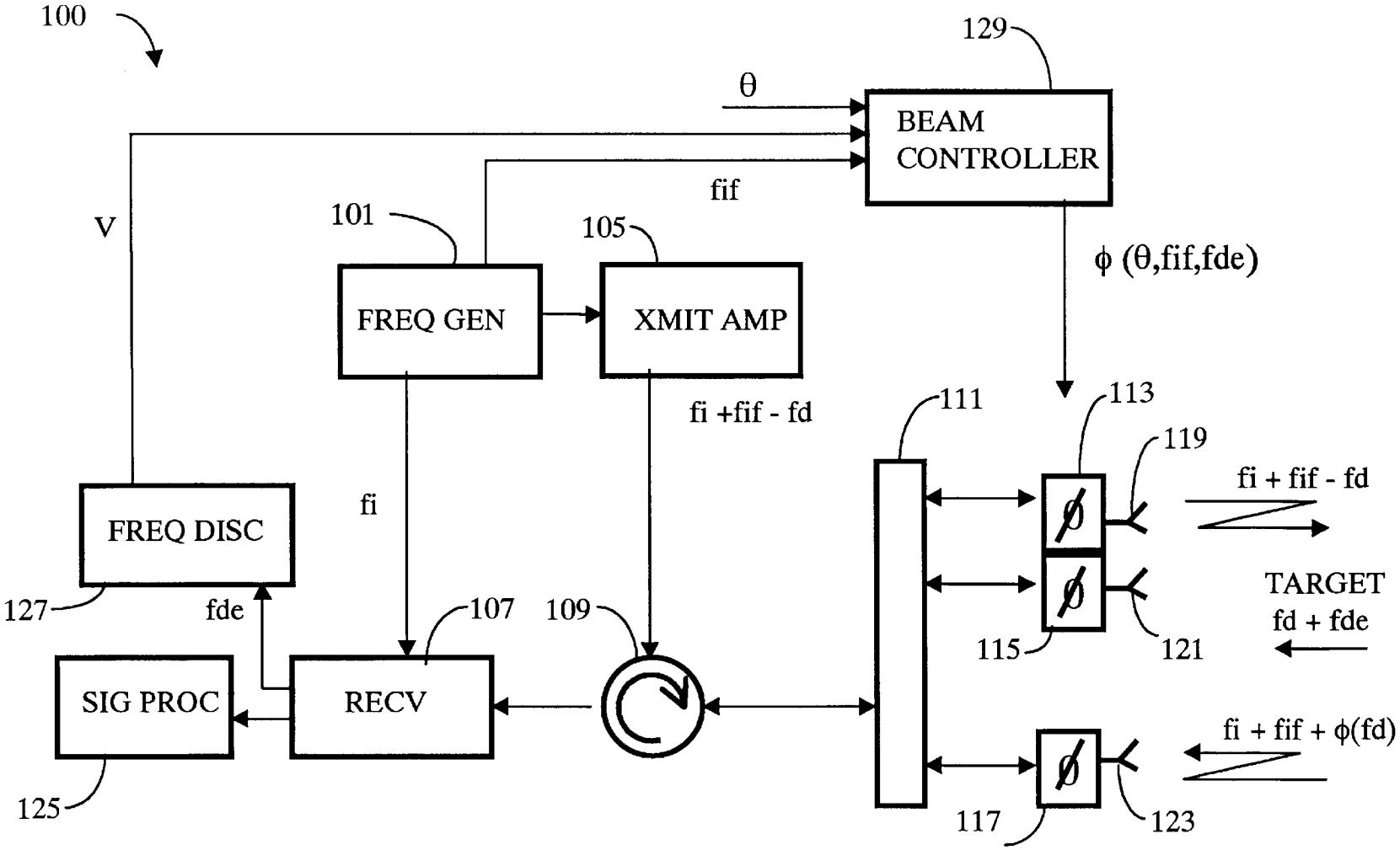
FIG. 3 illustrates a preferred embodiment of the invention for a passive phased array radar.
Figure 4:
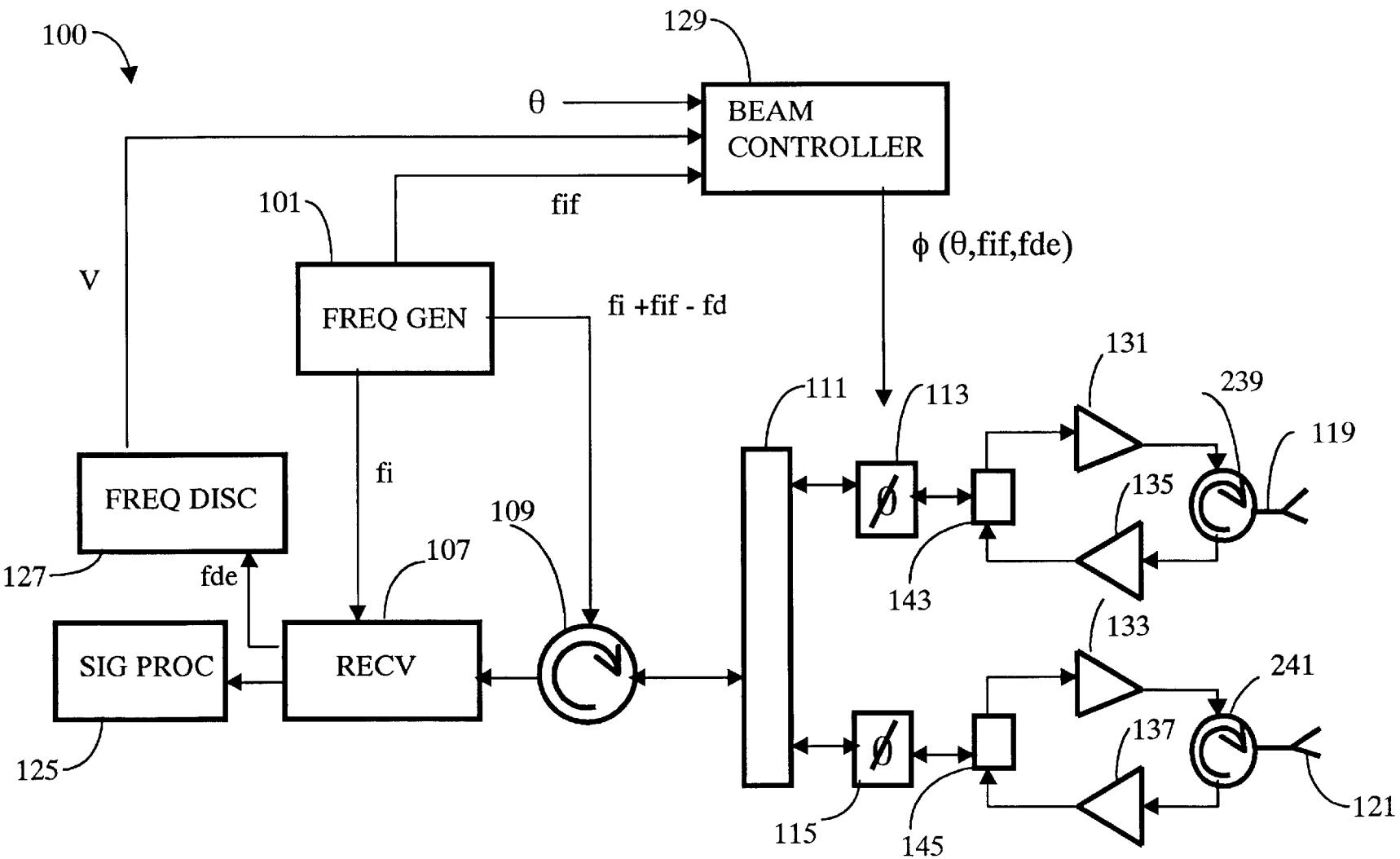
FIG. 4 illustrates a preferred embodiment of the invention for a active phased array radar.

FIG. 3 and FIG. 4 illustrate the improved passive and improved active, respectively, phased arrays of the invention. In both versions, pre-selected intermediate frequency, fif, generated by frequency generator 101 is input directly to beam steering controller 129 as is voltage, V, from frequency discriminator 127. Voltage, V, represents the frequency error (fde) which is the difference between the doppler compensation frequency (fd) and the actual target doppler frequency. The frequency error, fde, is used by the beam steering controller to produce an updated fd (i.e. update the fd from the previous cycle of the radar) which, in turn, is processed with fif and pre-selected beam steering angle, θ, to produce phase control signal. The phase control signal is input to individual phase shifters 113, 115, 117, to adjust the phase of transmit signal and serrodyne-modulate the transmit signal to add fif and the updated fd. The adjusted and modulated transmit signal is properly steered when emanating from radiating elements 119, 121, 123 toward the target (not shown). Thus, in the improved passive and active phased array radars, the beam steering and single-sideband modulation is accomplished simultaneously in the phase shifters.

Phased array radars are used extensively in the military. The Army's Patriot Air Defense system utilizes a passive phased array radar for fire control and the next generation of tactical missile defense radar being developed under the ground based radar program is based on active phased array architecture. Therefore, any improvement in the phased array radar has potential for wide military application.

Although a particular embodiment and form of this invention has been illustrated, it is apparent that various modifications and embodiments of the invention may be made by those skilled in the art without departing from the scope and spirit of the foregoing disclosure. Accordingly, the scope of the invention should be limited only by the claims appended hereto.

We claim:

1. In a passive phased array radar having a receiver for producing frequency error signal; a beam-steering controller for producing phase control signals in response to a pre-selected beam steering angle; a plurality of phase shifters, each of the shifters being coupled to the controller to receive therefrom the phase control signals and adjust the phase of transmit and received energy in response to the phase control signals; and a plurality of radiating elements, one of the elements being coupled to one of the phase shifters, the elements being suitable for transmitting and receiving energy; the improvement for enabling simultaneous performance of single-sideband modulation and beam steering, said improvement comprising: a frequency generator coupled simultaneously to the beam-steering controller and to the receiver, said generator being suitable for generating a first signal at a pre-selected radar reference frequency and a second signal at a pre-selected radar intermediate frequency and providing said first signal to the receiver and said second signal to the beam-steering controller; and a frequency discriminator coupled simultaneously to the receiver and the beam-steering controller, said descriminator being suitable for receiving the frequency error signal from the receiver and, in response to the frequency error signal, producing and transmitting to the beam-steering controller a voltage, said voltage being representative of said frequency error signal, thereby enabling the beam-steering controller to combine said voltage and said second signal with the pre-determined beam-steering angle to produce the phase control signals, the phase control signals being input to the phase shifters to be used thereby for simultaneous beam steering and single-sideband modulation of transmit energy.

2. In an active phased array radar having at least one power amplifier for amplifying transmit signals; at least one low noise amplifier for amplifying received signal; a receiver for producing frequency error signal; a beam-steering controller for producing phase control signals in response to a pre-determined beam steering angle; a plurality of phase shifters, each of the shifters being coupled to the controller to receive therefrom the phase control signals and adjust the phase of transmit and receive energy in response to the phase control signals; and a plurality of radiating elements, one of the elements being coupled to one of the phase shifters, the elements being suitable for transmitting and receiving energy; the improvement for enabling simultaneous performance of single-sideband modulation and beam steering, said improvement comprising: a frequency generator coupled simultaneously to the beam-steering controller and to the receiver, said generator being suitable for generating a first signal at a pre-selected radar reference frequency and a second signal at a pre-selected radar intermediate frequency and providing said first signal to the receiver and said second signal to the beam-steering controller; and a frequency discriminator coupled simultaneously to the receiver and the beam-steering controller, said descriminator being suitable for receiving the frequency error signal from the receiver and, in response to the frequency error signal, producing and transmitting to the beam-steering controller a voltage, said voltage being representative of said frequency error signal, thereby enabling the beam-steering controller to combine said voltage and said second signal with the pre-determined beam-steering angle to produce the phase control signals, the phase control signals being input to the phase shifters to be used thereby for simultaneous beam steering and single-sideband modulation of transmit energy.

* * * * *